United States Patent [19]

Steinbacher

[11] 4,050,500

[45] Sept. 27, 1977

[54] METHOD OF MAKING A SHELL MOLD

[75] Inventor: Jack T. Steinbacher, Vassar, Mich.

[73] Assignee: Eaton Corporation, Cleveland, Ohio

[21] Appl. No.: 667,050

[22] Filed: Mar. 15, 1976

[51] Int. Cl.[2] ..... B22C 1/22; B22C 1/18

[52] U.S. Cl. ..... 164/16; 164/21; 164/43; 164/361

[58] Field of Search ..... 164/21, 43, 361, 23, 164/24, 16; 427/134

[56] References Cited

U.S. PATENT DOCUMENTS

| | | | |
|---|---|---|---|
| 2,748,435 | 6/1956 | Hackett | 164/23 |
| 2,837,798 | 6/1958 | Bleuenstein | 164/43 X |
| 3,511,302 | 5/1970 | Barron | 164/361 X |

FOREIGN PATENT DOCUMENTS

| | | | |
|---|---|---|---|
| 619,560 | 5/1961 | Canada | 164/21 |
| 819,391 | 9/1959 | United Kingdom | 164/21 |
| 823,970 | 11/1959 | United Kingdom | 164/21 |
| 1,031,587 | 6/1966 | United Kingdom | 164/361 |

*Primary Examiner*—Ronald J. Shore
*Attorney, Agent, or Firm*—Teagno & Toddy

[57] ABSTRACT

A stronger, thinner shell mold suitable for making cast metal parts comprises a base member of resin bonded sand and a second surfacing layer of a cured thermosetting binder material. Also disclosed is a method for forming the new shell mold.

4 Claims, 2 Drawing Figures

Fig. 1.
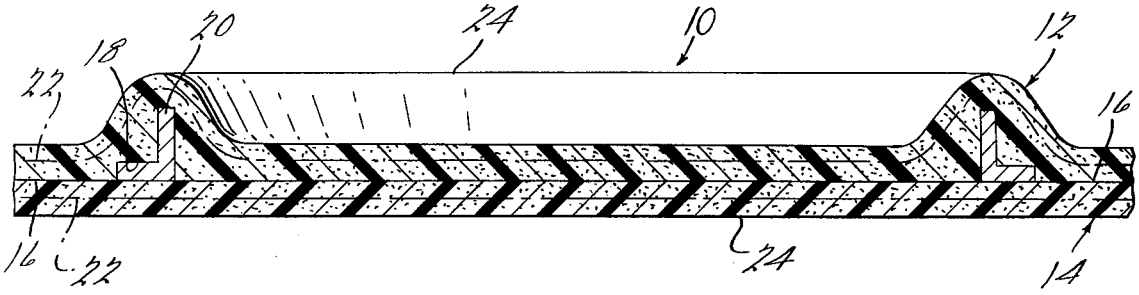
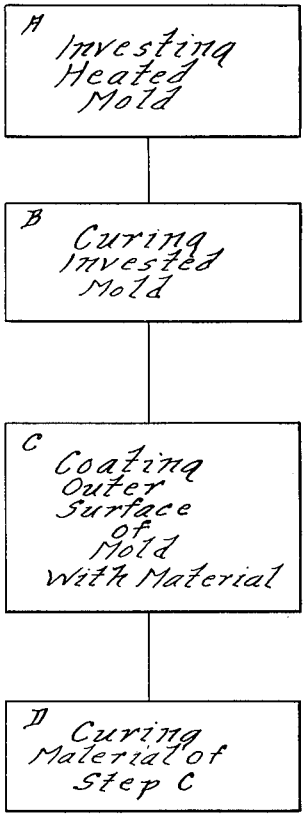
Fig. 2.

METHOD OF MAKING A SHELL MOLD

BACKGROUND OF THE INVENTION

1. Field of the Invention

In one aspect this invention relates to shell molding. In a further aspect, this invention relates to a method of making shell molds. In yet a further aspect, this invention relates to shell molds used in the shell molding process.

2. Description of the Prior Art

Shell molding methods and equipment were introduced in the United States about 20 years ago. Since then shell molding has gained a wide acceptance, and today thousands of parts are produced using the shell molding process. The process allows the production of cast articles having a good surface finish but without the cost inherent in forming an investment cast article.

Generally, shell molding consists of making a pattern which can be heated, the patterns normally being metal. The pattern is heated to an elevated temperature on the order of 400° F or higher and then coated with a sand-resin mixture, such as ordinary silica sand coated with phenol-formaldehyde resin. The heat from the heated pattern causes an initiating or curing agent present in the resin to cure the resin to a hard thermoset material bonding the sand grains into a self-supporting mold.

The side of the mold which contacts the pattern will be fully cured by the heat present in the pattern into a shape suitable for use as the interior of the mold. Resin in the portion of the mold furthest away from the heated pattern will melt into a thermoplastic material which adheres the grains together. The molds which are normally made in two mating pieces, are usually passed through a radiant heating area such as a gas or electric furnace which cures the thermoplastic resin on the back portion of the mold. The two halves of the pattern can then be cemented together and cured to form a cavity suitable for receiving molten metal.

In general, the shell molds used in the prior art have a buildup of at least one-fourth inch, many of the molds being ½ inch or more. A thick mold is required to hold the cast liquid metal in position within the mold during solidification of the metal since the resin present which bonds the sand will carbonize and eventually decompose under the intense heat of the molten metal.

The thickness of the prior art shell mold is undesirable in that the cost of making molds increases with increasing thickness. The primary cost factor is the resin used to bond the sand. Resin is considerably more expensive than sand. The greater the amount of sand used, the greater the amount of resin which is also used. In addition, thick molds require greater amounts of heat to cure the resin binder. Also, the thicker molds require longer curing times.

SUMMARY OF THE INVENTION

It is an object of this invention to provide a thinner, less expensive mold suitable for use in normal shell mold castings.

It is a further object of this invention to provide a mold which is stronger for a given thickness than the prior art shell molds.

In making the shell mold of this invention a heated pattern is invested or covered with a resin coated sand. The pattern's heat will cure at least a portion of the resin nearest the heated pattern and melt the remaining resin to a thermoplastic state adhering the sand particles together.

The resulting invested pattern is heated to complete the cure of the resin resulting in a firm self-supporting shell. The shell or base layer has two sides. One side will form the interior of the finished shell mold and the other the exterior surface A thin coating of a second thermosetting binder material is applied to the exterior surface of the base layer opposite the interior surface. The second material penetrates part way into the shell mold and cures, thereby forming a reinforcing coating on the outer portion of the shell. The second material of this invention provides a particularly strong mold since the outer portion of the shell mold is the last area to decompose from the heat of the cast molten metal. This is precisely the area of the shell mold which is reinforced in the practice of this invention. Thus, the mold of this invention will have substantially more strength than the prior art molds without the coating.

When additional strength is not desired the shell thickness can be reduced. The thinner mold requires less sand and, therefore, less resin. As a reslt the shell mold is less expensive. Also, a thinner shell requires less energy, in the form of heat, to cure the resin and less cycle time to make the shell, thereby decreasing processing costs.

As a further feature the method of the present invention can use the residual heat in the mold after curing the resin bonded sand to cure the second thermosetting material. When this method of forming a reinforced shell mold is used, no additional heat, other than that ordinarily applied to the system, is necessary to form a stronger thin walled shell mold. The resulting mold is particularly efficient in terms of energy consumption.

As yet a further feature of this invention the secondary layer of thermosetting material does not penetrate the base layer more than about one half of its thickness. This concentrates the strength of the second material on the periphery of the mold where it is less susceptible to the heat of the cast metal.

BRIEF DESCRIPTION OF THE DRAWING

In the accompanying drawing:

FIG. 1 is a side elevation in section of a mold made according to the practice of this invention; and FIG. 2 is a simple flow diagram of a method of making the shell mold of this invention.

DESCRIPTION OF THE PREFERRED EMBODIMENTS

Shown in FIG. 1 of the drawing is a shell mold 10 formed from a plurality of sand grains bonded together at their points of contact by a thermosetting resin to form a porous resin bonded body. As shown, the cope 12 and drag 14 have been bonded together along a parting line 16. The resulting cavity 18 has a casting 20 therein. The outer surfaces of the cope 12 and drag 14 have been treated with a second thermosetting material which has penetrated into the porous body and cured to a hard thermoset material. A typical penetration is shown by line 22 in the figure. As shown the second material has penetrated the outer surface 24 of the mold to a depth which is generally less than about one-half the total thickness of the pattern. The second material provides additional strength to the mold's outer surface which is least effected by molten metal, making the mold stronger for a given thickness.

The sands useful in making the mold of this invention can be chosen from the sands normally used in shell molding, such as the well known silica sand or zirconia sand as well as other refractory granules used in the casting art. A further discussion of suitable sands, resins, molding and casting techniques can be found in *Shell Process Foundry Practice,* second edition, American Foundrymen's Society, Des Plaines, Ill., 60016 (1973).

The resins used to bind the sand together to form an initial base member are known in the art and do not comprise a part of this invention. Suitable resins include phenol-aldehydes, novolaks, epoxides, polyurethanes and melamines. Other thermosetting resins are known in the art. The properties and processing requirements of resins are well known to those skilled in the art of making shell molds.

The second thermosetting material which is used to coat the outer surface of the shell mold can be chosen from various materials such as those noted hereinbefore as suitable for bonding the sand. In addition to the phenol-aldehydes, melamines, and mixtures thereof cited hereinbefore; other organic thermosetting materials such as isocyanurates and polycarbodiimides can also be used as the second material for surfacing the outer layer of the shell mold. A class of low-temperature curing resins are the diallyl phthalates sold under the trade name "Dapon" by FMC Corporation, Chicago, Illinois. These resins can be cured using tertiary butyl perbenzoate or benzoyl peroxide as the initiator at temperatures in the 250° - 300° F range.

In addition to thermoset organic resins, an inorganic substance can also be used. One example of a thermosetting inorganic material which is useful in the practice of this invention is sodium silicate, commonly known as "waterglass." Sodium silicate can be cured by means of carbon dioxide or other acidic material to set the sodium silicate. Sodium silicate does not wet the sand or resin material used in making the base member of the shell mold. Therefore, a wetting agent is generally added to the sodium silicate solution to enhance its penetration into the pores of the base member. Of course, wetting agents can also be used with organic resins where desired. In fact, sodium silicate has shown itself to be an excellent material for use in the practice of this invention. It is easily applied, readily available and moderately priced. These factors provide financial benefits which make sodium silicate the presently preferred binder for most applications. Sodium silicate, when used as the second material, may not penetrate deeply into the mold. In fact, it has a tendency to form a glaze on the surface of the mold which provides a good supporting surface.

Functionally stated, the preferred resins in the practice of this invention are resins which will cure to a hard thermoset material using only the residual heat present in the mold after curing. By use of the material which is self curing using the residual heat, additional energy need not be expended to form the strong thin mold of this invention.

Functionally, the second binder or resins should hold the outer portion of the shell mold in a rigid position until the casting has a self-supporting skin of solid metal. Of course, the resin binding the sand on the inner portion of the mold will decompose very rapidly, but as long as the exterior portion of the shell mold remains rigid the sand grains will remain in position. The temperatures at which the second resin material decomposes varies with the metal being cast. For iron and iron alloys which are cast at temperatures approaching 3,000° F the second material must withstand high temperatures, e.g., up to 1,200° F, and work for a short period, e.g., about 15–30 seconds, without fully decomposing. In general, smaller parts require the shorter times and the larger castings require a longer time. When aluminum and copper alloys are cast, the second material can decompose at a lower temperature since the casting temperatures of these alloys are considerably below the casting temperature of iron based alloys. In any event, it is desirable for the second thermoset material to maintain its integrity until the casting is completely poured and partially solidified.

The resins used in the practice of this invention can be applied as liquids by spraying or other liquid coating techniques. The resin can also be applied as a powder by dusting, spraying or other powder coating techniques. Whatever coating technique is used, the resin will generally penetrate at least a small distance into the base layer before fully curing to a thermoset material.

One example of a part made using the technique of this invention is a 2½ inches long generally tubular article weighing about 1 pound. When 18 of these castings are formed into a tree the castings, runners, and associated structure require about 40 pounds of cast metal.

A shell mold made according to conventional practices for the 18 casting structure weighs about 25 pounds and has a nominal thickness of about ⅜ inch.

By coating a formed mold with a second resin the weight of the mold can be reduced from 25 to 15 pounds, and the thickness can be reduced from about ⅜ inch to ¼ inch. This represents a reduction in mold weight of 40 percent and in thickness of 50 percent. It is understood by those skilled in the casting art that the thickness values are representative values because shell molds vary markedly in thickness from area to area on the pattern. In general, it can be said that the practice of this invention provides a mold which requires 30–40 percent less sand than conventional techniques. Thus, it is obvious that the molds of this invention provide a mold which is less expensive because they require less resin bonded sand, a shorter cycle time and less heat for curing.

Various modifications and alterations of this invention will become obvious to those skilled in the art without departing from the scope and spirit of this invention. It is understood that this invention is not limited to the illustrative embodiment described hereinbefore.

I claim:

1. A method of making a thin reinforced shell mold from a resin-coated sand comprising the steps of:

A. investing a heated pattern with a mixture of sand and thermal setting resin to coat the heated pattern;

B. heating the coated pattern to cure the resin forming a base layer for the shell mold, the interior surfaces of the base layer being adapted to receive molten metal for forming a cast article;

C. applying a thin coating of a solution of inorganic silicate and a wetting agent to the external surfaces of the base layer opposite the internal surfaces, the material penetrating at least a portion of the base layer; and D. curing the inorganic silicate to form a reinforced thin shell mold.

2. The method of claim 1 wherein the heat for curing the inorganic silicate is residual heat provided by the base layer of resin bonded sand.

3. The method of claim 1 wherein the silicate is sodium silicate and the silicate is applied so as to penetrate no more than about 50% of the thickness of the base layer.

4. The method of claim 1 where the sodium silicate binder is exposed to an acidic insolubilizing agent chosen from the class consisting of: carbon dioxide, or a weak solution of an inorganic acid.

* * * * *